US008539898B1

(12) United States Patent
Sylvia et al.

(10) Patent No.: US 8,539,898 B1
(45) Date of Patent: Sep. 24, 2013

(54) UNDERWATER VEHICLE WITH IMPROVED CONTROLS AND MODULAR PAYLOAD

(75) Inventors: Russell M. Sylvia, South Dartmouth, MA (US); Christopher R. Makuch, Fairhaven, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 377 days.

(21) Appl. No.: 12/730,675

(22) Filed: Mar. 24, 2010

(51) Int. Cl.
*B63G 8/00* (2006.01)

(52) U.S. Cl.
USPC ..... 114/312

(58) Field of Classification Search
USPC ..... 114/312
See application file for complete search history.

(56) References Cited

U.S. PATENT DOCUMENTS

| | | | | |
|---|---|---|---|---|
| 6,027,053 | A * | 2/2000 | Anderson et al. | 239/681 |
| 6,745,426 | B1 * | 6/2004 | Knowles | 15/104.04 |
| 6,827,310 | B1 * | 12/2004 | Whitham | 244/3.24 |
| 7,290,496 | B2 | 11/2007 | Asfar et al. | |
| 7,337,741 | B1 | 3/2008 | Ansay et al. | |
| 7,353,768 | B1 | 4/2008 | Jones et al. | |
| 7,415,937 | B2 | 8/2008 | Giesler et al. | |
| 7,540,255 | B2 | 6/2009 | Hawkes | |
| 7,613,553 | B1 | 11/2009 | Benjamin | |
| 2002/0033126 | A1 * | 3/2002 | Tolkoff et al. | 114/20.1 |
| 2002/0049012 | A1 | 4/2002 | Kirkwood et al. | |
| 2005/0211827 | A1 * | 9/2005 | Barocela | 244/46 |
| 2006/0089794 | A1 * | 4/2006 | DePasqua | 701/208 |
| 2007/0022935 | A1 * | 2/2007 | Griffith et al. | 114/312 |
| 2009/0241826 | A1 | 10/2009 | Vosburgh et al. | |

* cited by examiner

*Primary Examiner* — Stephen Avila
(74) *Attorney, Agent, or Firm* — Howard IP Law Group, PC

(57) ABSTRACT

A system for enhancing control of an underwater vehicle, and providing a quick change modular payload section includes a motor configured to rotate an internally threaded member threadingly engaged with a threaded rod. Rotating the member creates linear motion of the threaded rod. A control rod connected to the threaded rod provides movement of a rudder or fin. The threaded rod and member are configured with threads having a fine pitch which maintains a stable position of the fins without needing to supply power to the motor for adjustments. The modular payload arrangement includes a bulkhead ring having L-shaped recesses that receive fasteners disposed on a central body section. The payload section may be fastened to the vehicle by pressing the payload section onto the central body such that the fasteners align with the recesses and turning the payload section to secure the payload section.

20 Claims, 12 Drawing Sheets

UNDERWATER VEHICLE WITH IMPROVED CONTROLS AND MODULAR PAYLOAD

FIELD OF THE INVENTION

The invention relates generally to control and payload systems for small underwater vehicles, and more particularly to an improved system for controlling position of a small underwater vehicle and for a modular payload system for a small underwater vehicle.

BACKGROUND OF THE INVENTION

A-size underwater vehicles (i.e., those having a size of about 4⅞" diameter×36" long) are often used as simulators for testing a variety of Navy shipboard systems. For example, such vehicles can be outfitted with systems that simulate the noise of a submarine or other water-borne vehicle or device, and are used to teach other systems to detect and recognize such noises as being associated with that specific device.

Currently there are no A-size underwater vehicles that employ stable, energy efficient, linear controls. At present, these small underwater vehicles have directional controls that are either binary (i.e., on-off) controls or which use linear motors that must be constantly electronically actuated to hold the vehicle on a desired position or course. Binary controls, which apply either full left rudder or full right rudder, cause the vehicle to swim erratically, while linear motors use too much power, since they employ a solenoid that must be constantly "on" in order to hold the rudder/elevator at a particular position. Thus, there is a need for an improved control system for an underwater vehicle that is stable, and that requires less power than existing systems.

Furthermore, current A-size underwater vehicles employ fixed payload sections which, as previously noted, may contain devices such as noisemakers for simulating the noise signature of a particular water-borne vehicle or device. Having a fixed payload section, however, limits use of the vehicle to specific applications and thus a larger number of such vehicles must be kept on hand to address a typical array of testing requirements. Thus, there is a need for an improved underwater vehicle having a simple modular payload arrangement that allows a variety of payloads to be simply and efficiently interchangeable with a single vehicle body.

SUMMARY OF THE INVENTION

A system is disclosed for controlling an underwater vehicle. The system may comprise a linear control assembly having a motor and a threaded rod. The motor may be engaged with an internally threaded member that is threadably engaged with the threaded rod. A control rod is connected to the threaded rod and a fin assembly is connected to the control rod. Thus arranged, actuation of the motor rotates the internally threaded member, thereby causing a linear movement of the threaded rod, the control rod, and the fin assembly.

A modular payload system is also disclosed for an underwater vehicle having a payload section and a central body section. The system includes a payload section having a bulkhead section, and a central body section. The central body section may have a circumferential lip portion and a plurality of fasteners circumferentially disposed on the lip portion. The bulkhead section may further include a plurality of L-shaped recesses positioned to receive the plurality of fasteners, each of the L-shaped recesses having an axially-disposed opening and a transversely disposed locking section. The central body section is engageable with the bulkhead section by aligning the plurality of fasteners with the axially-disposed openings of the recesses, pressing the bulkhead section toward the central body portion, and twisting the bulkhead portion with respect to the central body portion to engage the plurality of fasteners with the transversely disposed locking sections of the plurality of recesses.

DESCRIPTION OF THE DRAWINGS

The details of the invention, both as to its structure and operation, may be obtained by a review of the accompanying drawings, in which like reference numerals refer to like parts, and in which.

DETAILED DESCRIPTION

Figure 1:
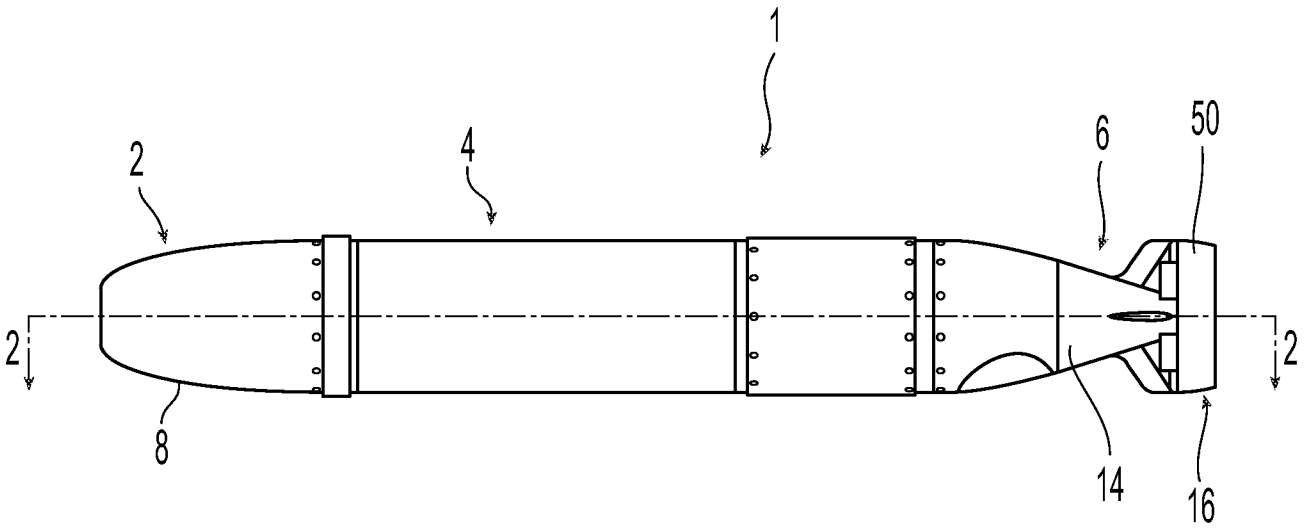
FIG. 1 is a side view of an A-size underwater vehicle.

In the accompanying drawings, like items are indicated by like reference numerals. This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The disclosed system comprises an underwater vehicle having directional controls including screw-type linear actuators and position feedback controls. The screw-type linear actuators hold fin position using a fine pitched thread, which requires no continuous external electric power to maintain position. The disclosed system provides increased accuracy and control of the underwater vehicle as compared to current systems. The screw-type linear actuator also minimizes noise and power consumption, since the incline of the screw holds its position under load, without the need for external electrical power.

The disclosed system also includes a modular payload arrangement in which a quick connect bulkhead section enables quick connection/disconnection of the payload section from the rest of the vehicle via a single faster and a plurality of retaining pins. With this arrangement the user can simply loosen one fastener and twists the payload section to detach the section from the vehicle. A single user can manipulate and deploy the vehicle in minutes on the deck of a ship or rubber inflatable boat (RIB). The disclosed design is self contained and makes swapping out payloads a clean and simple transition.

Figure 2:
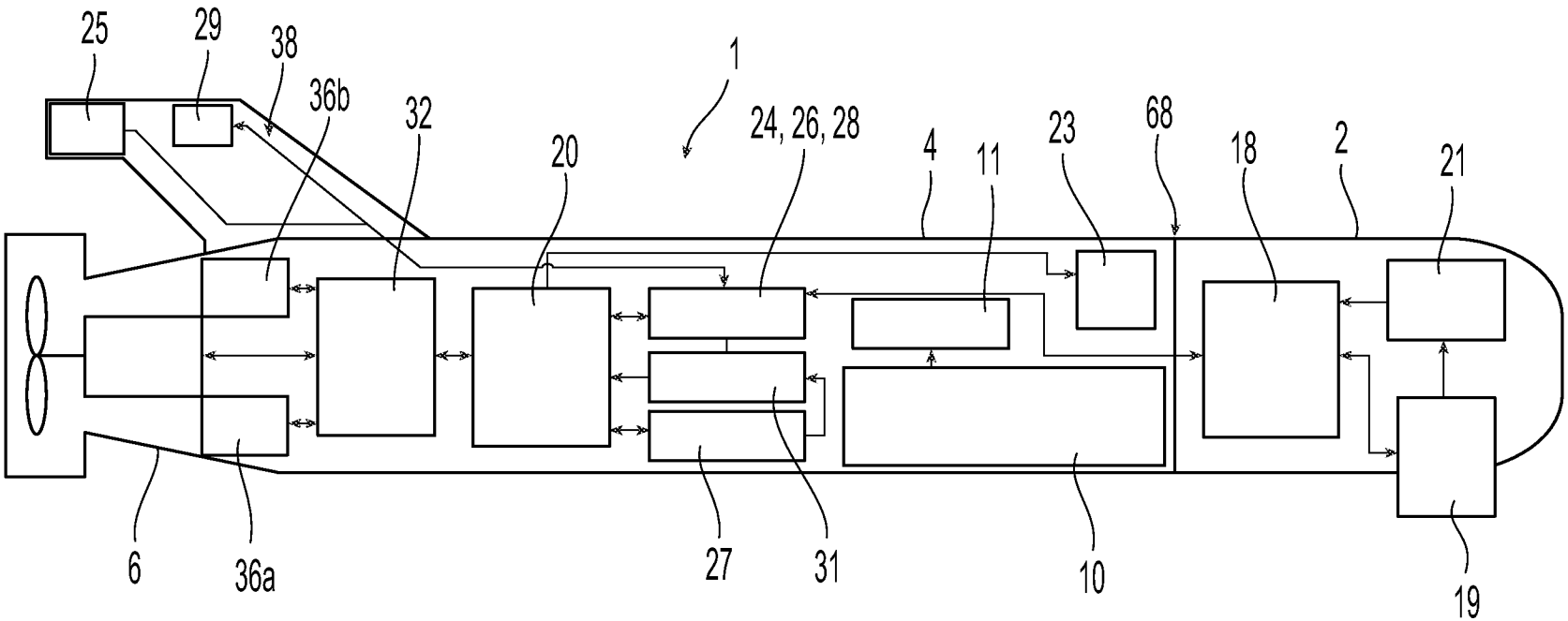
FIG. 2 is a schematic of the interrelation of the components of the vehicle of FIG. 1, taken along line 2-2.

Referring to FIGS. 1 and 2, an underwater vehicle 1 is shown having a forward payload section 2, a central body section 4, and an aft propulsion section 6. The payload section 2 may comprise a tapered nose 8 for reducing drag, while the central body section 4 may have a generally cylindrical shape and may contain the vehicle's battery assembly 10, guidance, navigation and communications components. The propulsion section 6 may include a tapered aft portion 14 ending in a propulsion and steering assembly 16.

The payload section 2 houses the vehicle's payload, which may include any of a variety of communications, sensing or ordnance devices, including, without limitation, sound simulation equipment, a camera, a Doppler velocity log, up-looking sonar, a conductivity-temperature-density measuring device, and the like. The payload section 2 may also include a standalone payload processor 18 for communicating with and/or controlling the payload. Where the payload is a sensor 19, the payload processor 18 may receive and process data from the sensor. A signal conditioner 21 may be provided in communication with the sensor 19 to condition signals from sensor prior to their transmission to the payload processor 18. The payload processor 18 may be in communication with a main processor 20 for the vehicle 1, and may function to reduce the processing load on the main processor. This is an advantage over prior designs in which the main vehicle processor 20 runs all controls and sensors in the vehicle. In one embodiment, the payload processor communicates with the main processor 20 and tells it what the sensor is sensing. For example, if the payload sensor senses a mine near the vehicle, the payload processor 18 may send a signal to the main processor 20 to instruct it to control the vehicle to perform a desired action (e.g., stay, go). In one embodiment, the payload processor 18 is disposed on the forward side of a quick disconnect bulkhead 68 (see FIG. 8) inside the payload section 2. It can communicate via a network cable to the main processor 20 via a single connection.

The main processor 20 may be connected to a data logger 23 to enable continuous storage of sensor and/or mission data received by and/or processed by the main processor 20. The main processor 20 may also be in communication with a plurality of vehicle sensors 27 such as depth sensors or the like. A signal conditioner 31 may be provided to condition signals from the vehicle sensors 27 sensor prior to their transmission to the main processor 20.

The payload section 2 may be connected to the central body section 4 using a quick connect/disconnect arrangement, which will be described in greater detail later. As previously noted, the central body section 4 may house the vehicle's battery 10, which may be a rechargeable or replaceable battery. In one embodiment, the battery 10 is fixed within the central body section 4 and is provided with a power interface to allow recharging by plugging the battery into a power source on board a host vessel. In another embodiment, the battery 10 is removable from the central body section 4 so that, when depleted, the battery can be unplugged and replaced with a fully charged battery to enable quick redeployment of the vehicle 1.

Figure 3:
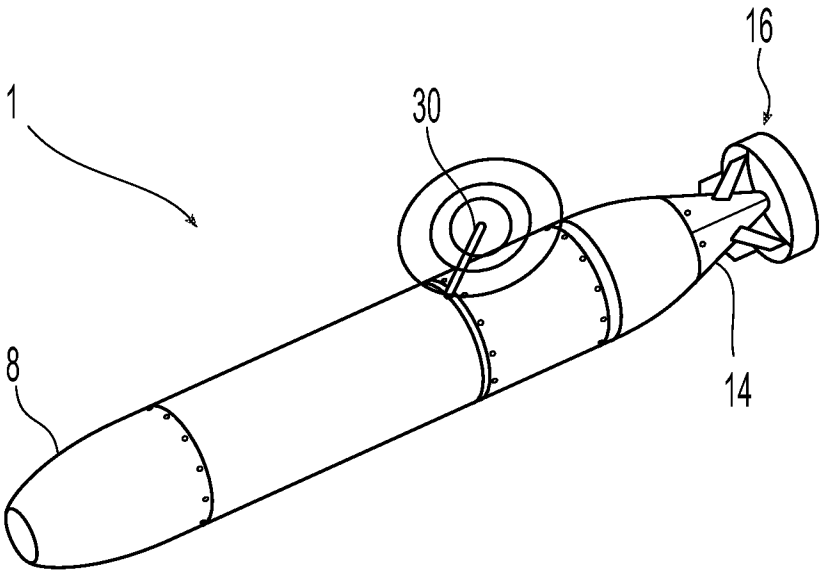
FIG. 3 is an isometric view of the vehicle of FIG. 1, showing the positioning of a communications antenna.

As noted, the central body section 4 may also include guidance, navigation and communications components. In one embodiment, these components include a series of printed wire boards (PWBs) in communication with the battery 10. These PWBs may control the navigation, guidance and control functions of the vehicle 1. The main processor 20 may be included on one of the PWB's, or it may be part of a separate board or card. Regardless of the physical arrangement, the main processor 20 communicates with, and controls the operation of, the PWBs. One of the PWB's may be a navigation board 24, which can include, or connect to, a compass or Inertial Measuring Unit (IMU) and a global positioning system (GPS) 25. Another of the PWB's may be a guidance board 26, which may include a control loop that accepts, for example, depth sensing information and vehicle heading information and controls the vehicle to turn, dive or surface. Another of the PWB's may be a communications board 28, which may include a WiFi connection 29, a satellite modem, and/or a control and mission algorithm to enable a ship-based or land-based user to communicate with the vehicle's main processor 20 or payload processor 18 while the vehicle is in the water or on the deck of a host ship. In one embodiment, the communications board 28 enables a user to locally program the main processor 20 and/or the payload processor 18 using a laptop computer or handheld device. The user may program a mission or run-plan for the vehicle 1 via the vehicle's wireless link. Alternatively, the wireless link may enable user to download data collected by the vehicle during its run. As shown in FIG. 3, the vehicle may be provided with an antenna 30 to facilitate modem operations. The antenna 30 may be embedded in the vehicle fin, mounted flush on the hull, or it may be retractable and/or optional depending on the vehicle's particular mission application.

The modem may also enable the payload processor 18 and/or the main processor 20 to communicate with other unmanned vehicles or with a local buoy, which can then transmit data collected by the vehicle (or vehicles) to a satellite transmission system and/or a nearby vessel. In one embodiment, the vehicle may collect data, surface, and call a host ship. The host ship may then retrieve the vehicle and download the vehicle's collected data to a shipboard computer.

The battery 10 may be connected to a DC/DC converter 11 for powering the PWB's 24, 26, 28. In addition, battery power may be used, either directly, or via the DC/DC converter 11, to power some payloads.

The propulsion section 6 is positioned immediately aft of the central body section 4 and may be attached thereto by a permanent or removable connection. As shown in FIG. 2, the propulsion section 6 may include a linear actuator control 32, a propulsion motor 34, linear actuators 36*a, b* and a steering assembly 16. The steering assembly 16 may include a pair of rudders 38, and a pair of elevators 40. The linear actuator control 32 is in communication with one or more of the PWB's 24, 26, 28 for receiving control commands from the main processor 20 and to instruct the linear actuators to start and stop.

Referring to FIGS. 4-7, the linear actuators 36*a, b* are shown, along with connections to the associated rudders 38 and elevators 40. Each of the linear actuators 36*a, b* includes a linkage rod 42*a, b* that connects to a central linkage 44*a, b* of the associated rudders 38 and elevators 40 to move the rudders/elevators via corresponding movement of the actuators. As can be seen, the individual rudders 38 are connected together via central linkage 44*a*, while the individual elevators 40 are connected together via central linkage 44*b*. The rudders 38 and elevators 40 further each include an extension rod 46, 48 that rotatably connects the rudder/elevator to an inner surface of the propeller shroud 50 (FIGS. 2, 5) so that when linear actuator 36*a* moves the central linkage 44*a*, the rudders 38 rotate together about the extension rod 46 to change their angle of inclination with respect to the vehicle. Likewise, when linear actuator 36*b* moves the central linkage 44*b*, the elevators 40 rotate together about the extension rod 48 to change their angle of inclination with respect to the vehicle.

Figure 5:
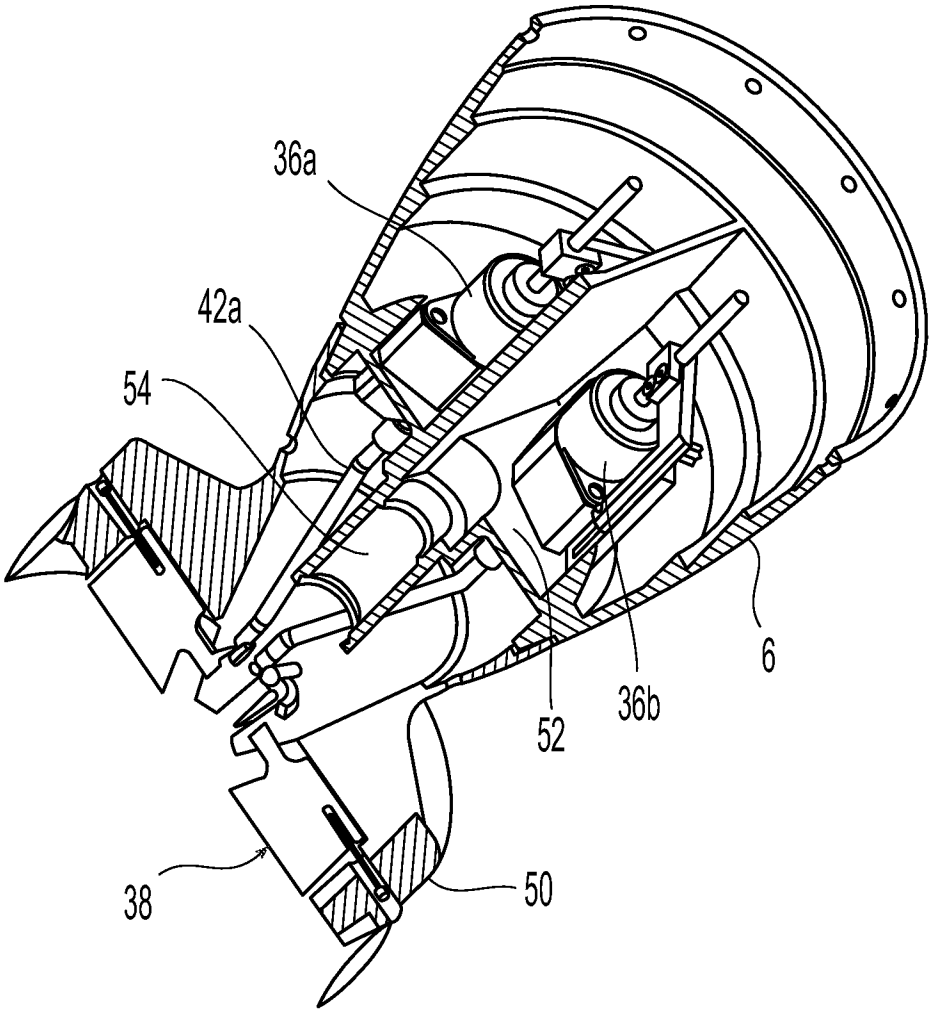
FIG. 5 is an isometric view of the control system of FIG. 4 fitted in the tail section of the vehicle of FIG. 1.
Figure 6:
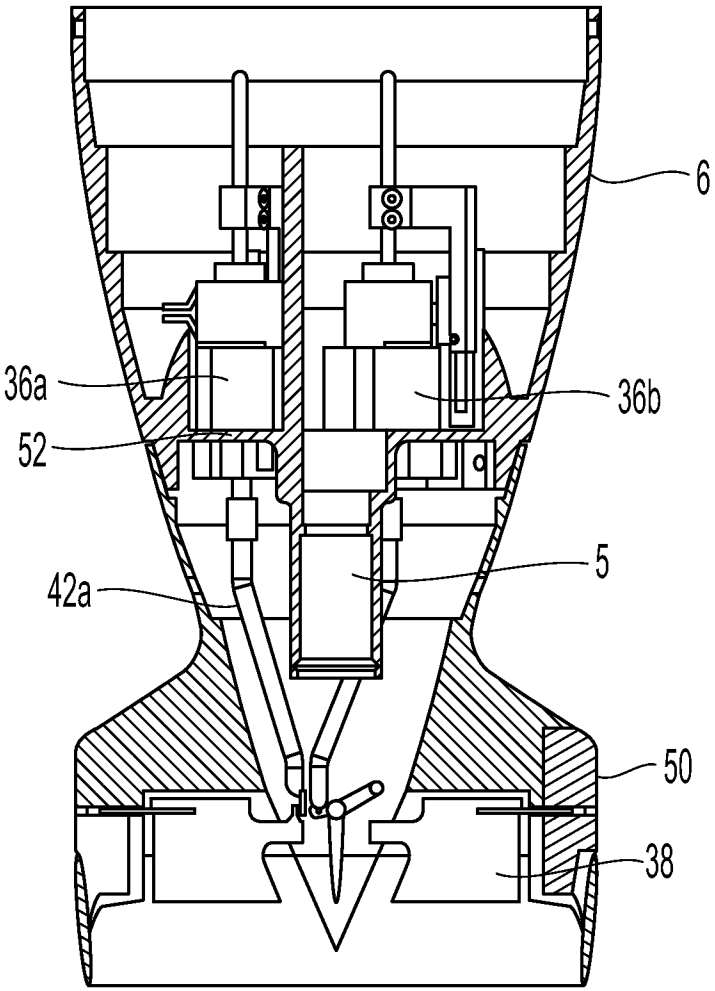
FIG. 6 is a side view of the control system and tail section of FIG. 5.
Figure 7:
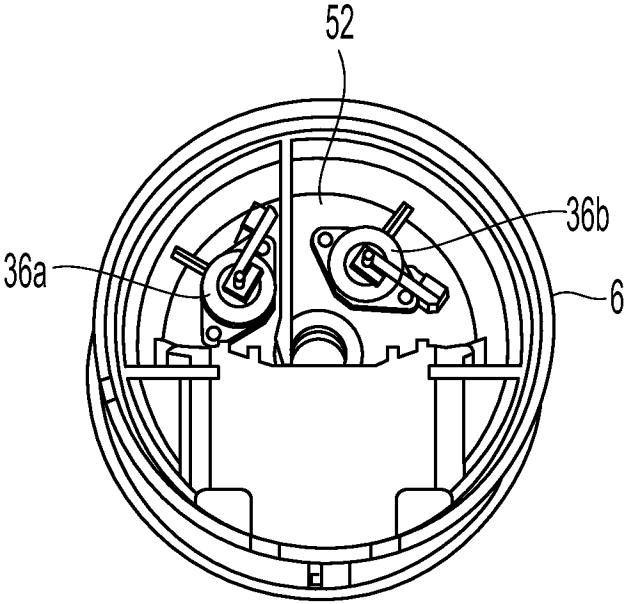
FIG. 7 is a top view of the control system and tail section of FIG. 5.

FIG. 5 shows the linear actuators 36*a, b* positioned within the aft structure of the propulsion assembly 6. In this embodiment, the actuators are mounted on an intermediate bulkhead 52 so that they straddle the opening 54 that houses the vehicle's propulsion shaft bearing and seal (not shown).

Figure 4:
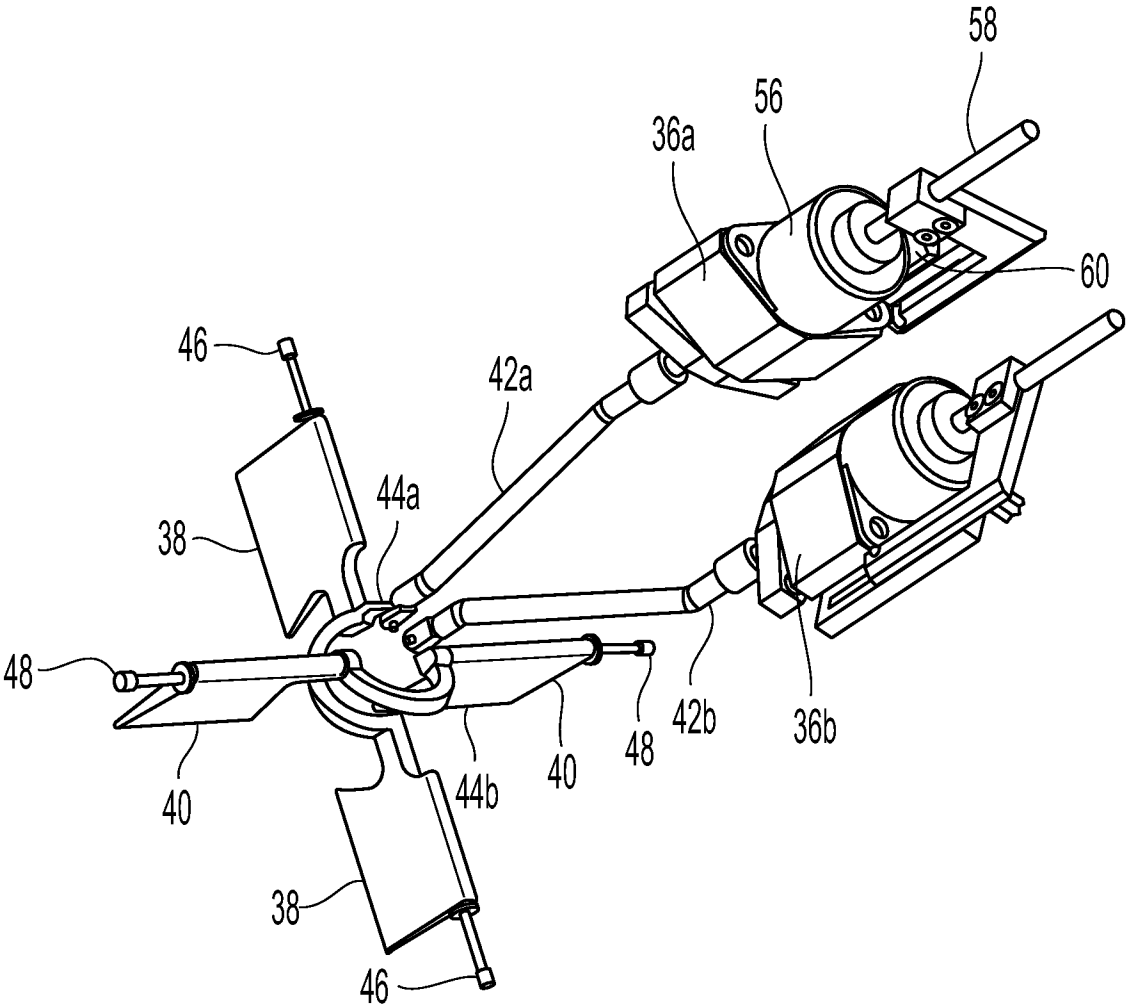
FIG. 4 is an isometric view of the disclosed control system for use in the vehicle of FIG. 1.
Figure 4A:
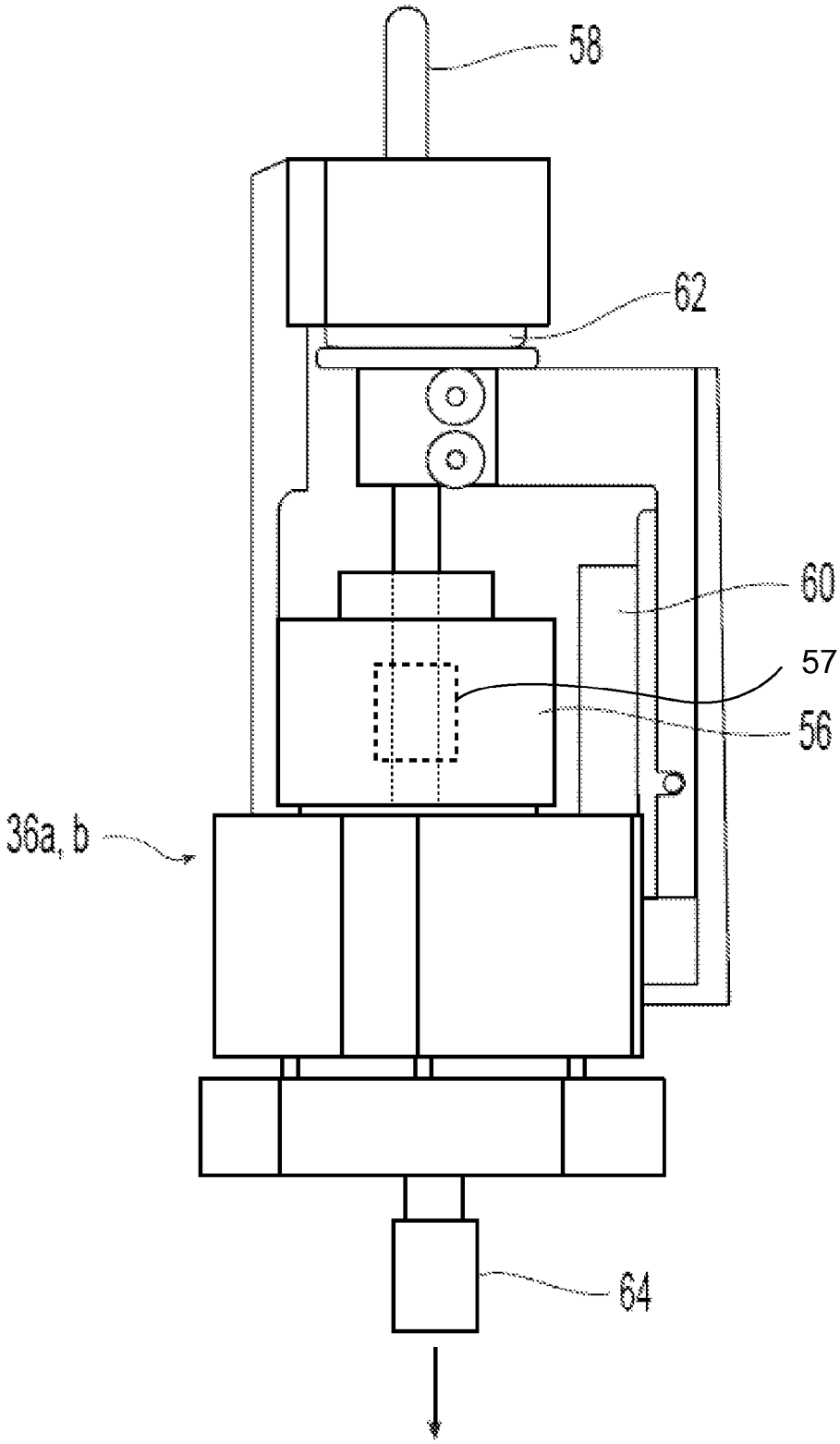
FIG. 4A is a side view of an exemplary linear actuator for use in the vehicle of FIG. 1.

Referring to FIG. 4A, each of the linear actuators 36*a, b* may comprise an actuator element 56, a threaded rod 58, a position sensor 60 and a spring compensator 62. A coupling 64 is provided at an aft end of the actuator 36*a, b* for engaging an associated extension rod 42*a, b*. The actuator element 56 may comprise a motor that spins a threaded nut 57, which in turn, engages the threaded rod 58 to more forward. Actuation of the motor in a second direction causes the threaded rod 58 to move aft. When coupled to an extension rod 42*a, b*, rotation of the motor controls the angular position of the rudders 38 and elevators 40.

In one embodiment, the position sensor 60 comprises a slide rheostat which changes resistance with a change in rod position. As the threaded rod 58 moves, the rheostat provides feedback to a control loop to inform the linear actuator control 32 that the elevators (or rudders) are positioned at, for example 10-degrees. The control system, in turn, can order a change in position by controlling the motor to spin the nut 57, thereby moving the threaded rod, and actuating the associated elevators/rudders to achieve the desired movement of the vehicle.

Self locking of the threaded rod 58 is obtained whenever the coefficient of friction is equal to or greater than the tangent of the thread angle. This is a function of pitch and friction. Thus, a fine thread per inch will produce this self-locking condition due to small thread angle and increased coefficient of friction.

The spring compensator 62 may be a coil spring calibrated to compensate for the forces of seawater pressure on the linear actuator 36*a, b*. As will be understood, sea pressures at increased depths can counteract the force of the linear actuators 36*a, b*, hindering or preventing them from moving the linkage rods 42*a, b*. This is because the linkage rods are subject to full sea pressure, while the linear actuators 36*a, b* are subject only to the pressures associated with the interior of the vehicle (the dividing line is shown in the figures as the intermediate bulkhead 52). To counteract the forces of sea pressure on the linkage rods, the spring compensator 62 provides a pre-load on the threaded rod 58 that acts in direction opposite to the load applied by the sea.

Thus arranged, the rudders 38 and elevators 40 can be adjusted simply by rotating the threaded nut and translating the associated threaded rod by a desired amount. Once a desired position of the elevators and/or rudders has been achieved, the actuator element 56 is turned off and the position of the rod (and the elevators or rudders) is held constant without the need for further operation of the actuators 36*a, b*. As previously noted, this fixed positioning feature results from the use of a fine thread pitch on the nut and threaded rod. Fine thread pitches are exceptionally resistant to rotation when subjected to large axial forces, such as the force of sea pressure and the forces applied to the rudders and elevators as the vehicle moves through the water.

Referring now to FIGS. 8-11, the disclosed modular connection arrangement between the payload section 2 and the central body section 4 will be described in greater detail. As previously noted, providing a quick connect/disconnect arrangement facilitates quick change-out of vehicle payloads and batteries, resulting in a highly versatile vehicle.

Figure 8:
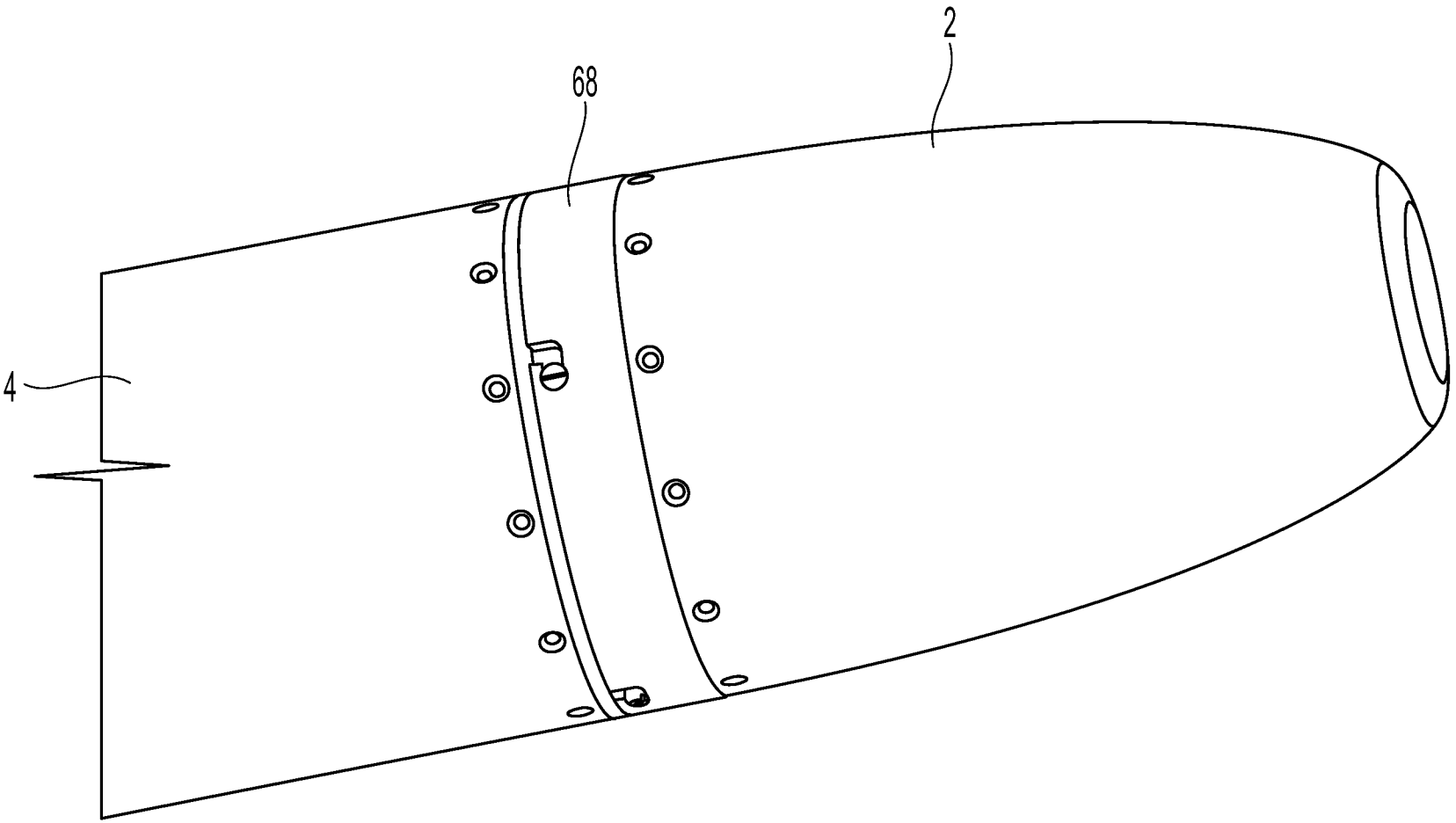
FIGS. 8-11 are isometric views of the connection arrangement between the body section and the payload section of the vehicle of FIG. 1.
Figure 11:
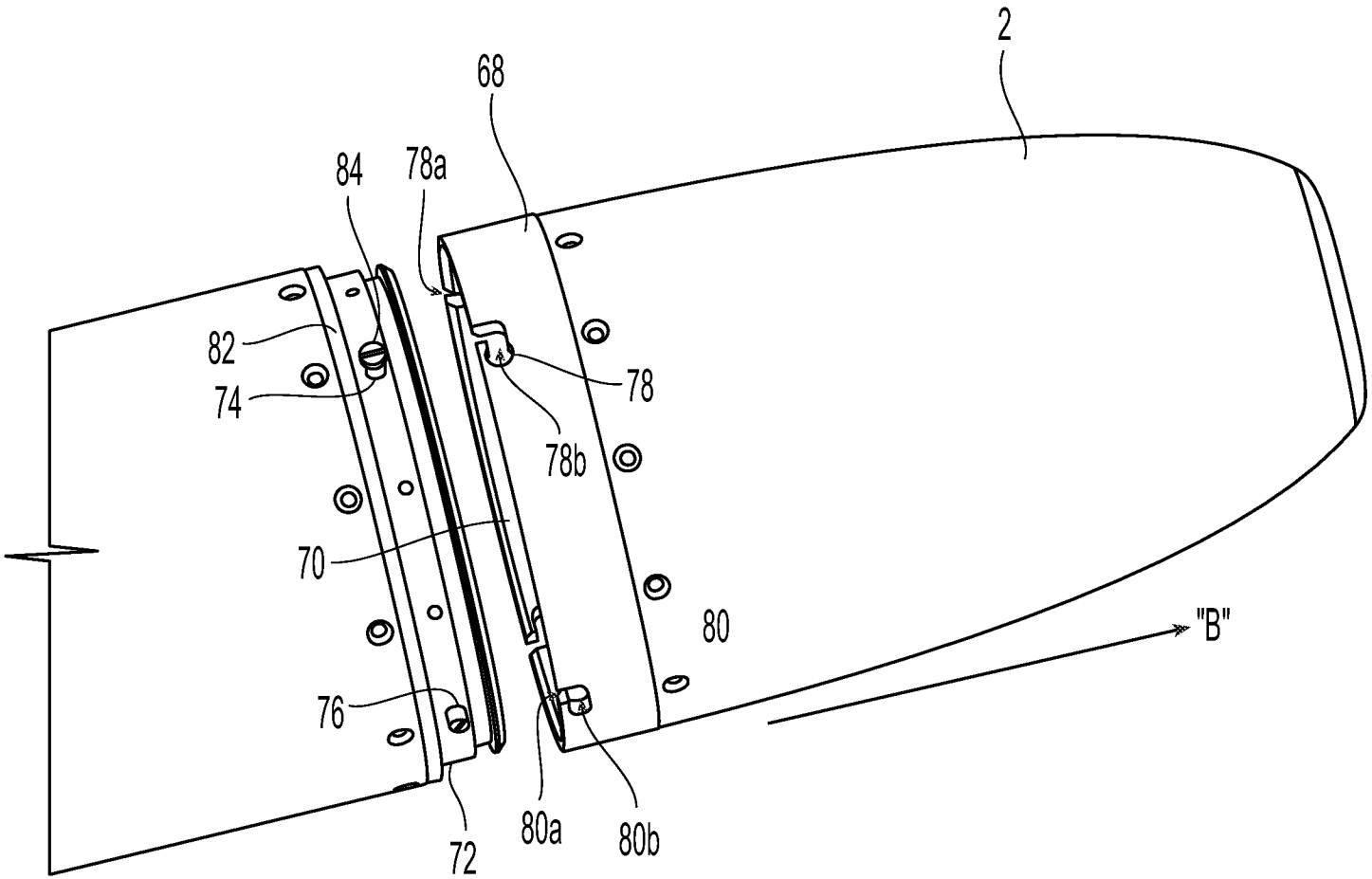

FIG. 8 shows the payload section 2 and central body section 4 connected via a quick disconnect bulkhead 68. The quick disconnect bulkhead 68 may be a cylindrical ring that approximates the outer diameter of the payload section 2 and the central body section 4 to provide a smooth and uninterrupted exterior surface between the sections. As shown in FIG. 11, the quick disconnect bulkhead 68 is sized so that its inner surface 70 fits over, and engages, a circumferential lip portion 72 of the central body section 4. An opposite side of the quick disconnect bulkhead 68 may be fixed to the payload section 2 by fasteners, welding or other appropriate connection arrangement. The quick disconnect bulkhead 68 may be sealed to the circumferential lip portion 72 of the central body section 4 via an o-ring seal.

The circumferential lip portion 72 of the central body section 4 may carry first and second fasteners 74, 76 configured to mate with corresponding first and second recesses 78, 80 in the quick disconnect bulkhead 68. In the illustrated embodiment, the first fastener 74 may be a screw-type fastener having an increased diameter head 82 and a threaded body 84 (FIG. 11). The first fastener 74 may be sized to engage the first recess 78 in the bulkhead 68. In the illustrated embodiment, the first recess 78 is an L-shaped recess having an axially-oriented open mouth section 78*a* and a transversely-oriented locking section 78*b*. The locking section 78*b* may have a bevel that matches a corresponding bevel of the head 82 of the first fastener 74 such that when the first fastener is engaged with the locking section 78*b* of the first recess 78 and the fastener is tightened, the head 82 of the fastener engages the locking section 78*b* to lock the bulkhead 68 to the central body section 4.

A plurality of second fasteners 76 may be provided at spaced intervals around the circumference of the circumferential lip portion 72. Likewise, a plurality second recesses 80 may be correspondingly spaced around the circumference of the quick disconnect bulkhead 68. In the illustrated embodiment, the second fasteners 76 are cylindrical pins, and the second recesses 80 are L-shaped recesses having an axially-oriented open mouth section 80*a* and a transversely oriented locking section 80*b*. In contrast to the first fasteners, the second fasteners do not have an increased diameter head portion, and thus they do not lock down onto quick disconnect bulkhead. Rather, they serve as retention pins, preventing axial movement of the payload section (and bulkhead section) with respect to the central body section when received within the locking section 80*b* of the associated recess.

It will be appreciated that, although the second fasteners 76 have been described as being pins, they (as well as the second recesses 80) could instead be of the same design as that of the first fasteners 74 and the first recesses 78. Further, although the illustrated embodiment contemplates a total of four fasteners and four recesses, fewer or greater numbers of fasteners and recesses could be provided as desired. It will also be appreciated that it is not critical to provide a separate bulkhead element, and thus the locking features described in relation to the bulkhead could instead be implemented directly in the payload section 2, or the bulkhead could be an integral part of the payload section or the central body section. Moreover, although the bulkhead is described as fitting over a portion of the central body section, an opposite arrangement could be provided, with fasteners provided on the bulkhead and corresponding recesses provided in the central body section.

Figure 9:
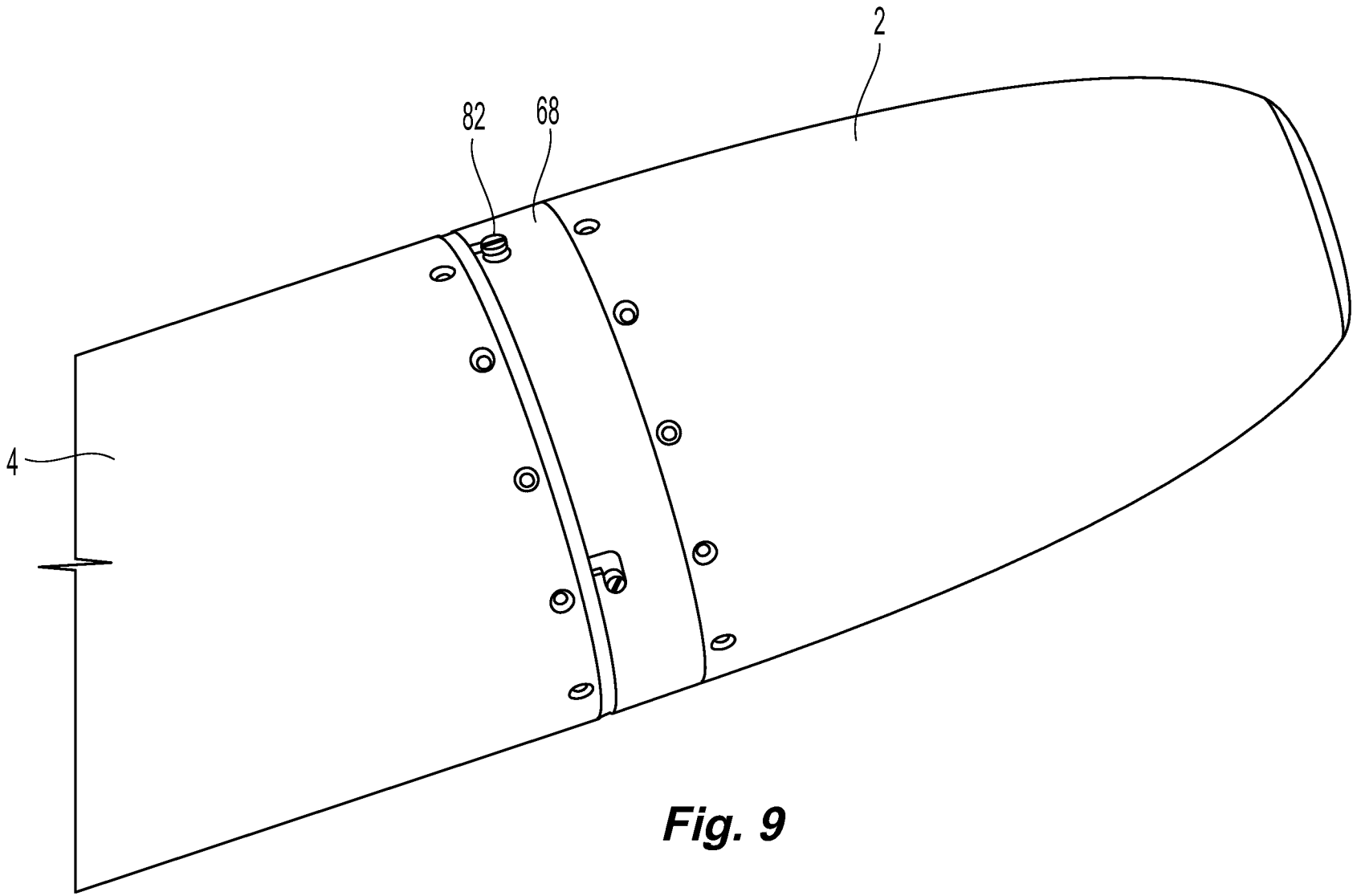
Figure 10:
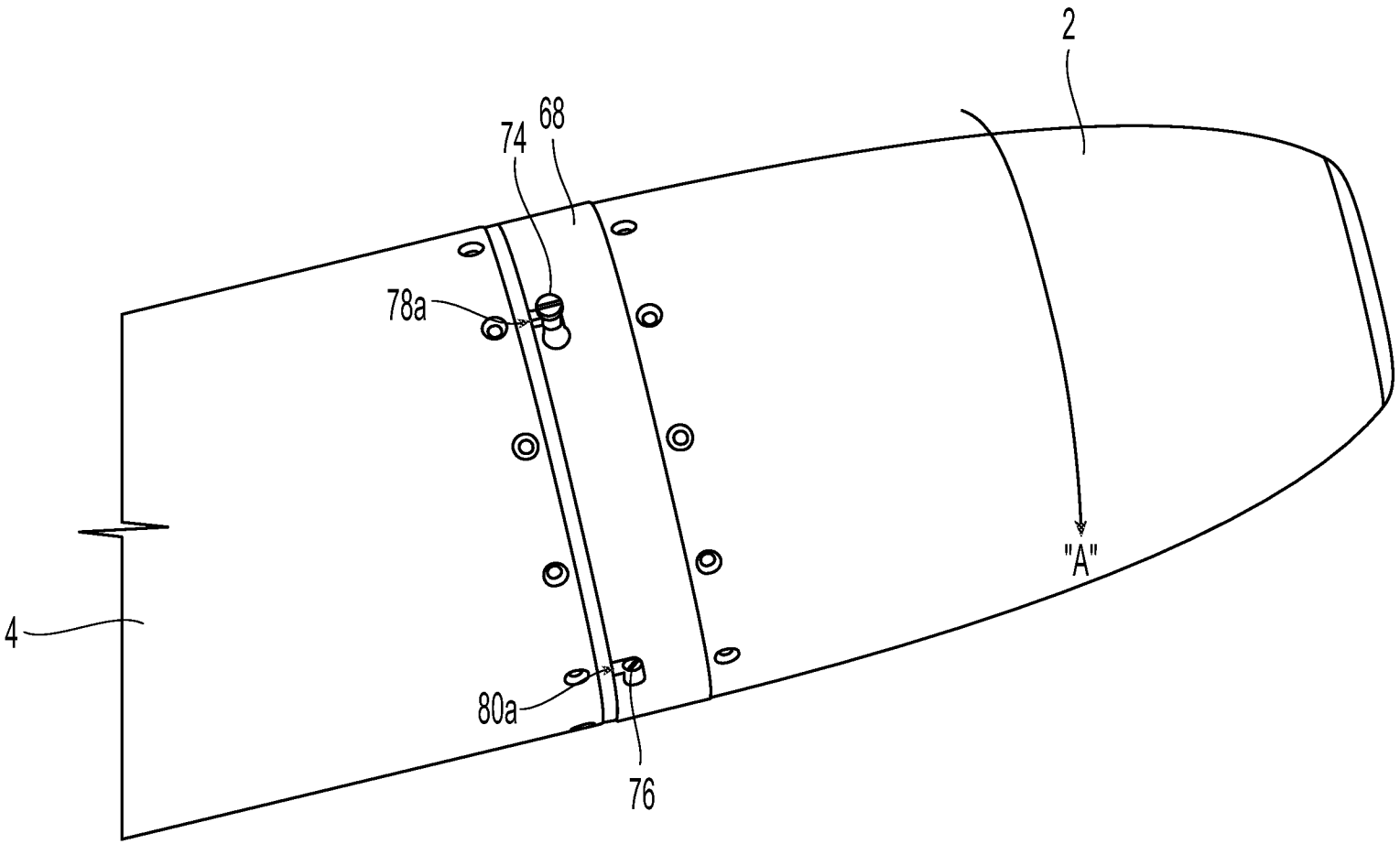

Referring again to FIG. 8, the quick connect bulkhead 68 is shown locked in place, with the first and second fasteners 74, 76 residing in the transversely oriented locking sections 78*b*, 80*b* of their respective recesses 78, 80. To disconnect the payload section 2 from the central body section 4, the first fastener 74 is loosened as shown in FIG. 9, so that the fastener head 82 disengages from the locking section 78*b* of the first recess 78. As shown in FIG. 10, the payload section 2 (and bulkhead 68) are then twisted in the direction of arrow "A" so that the first and second fasteners 74, 76 align with the axially oriented open mouth sections 78*a*, 80*a* of the associated recesses 78, 80. Since the second fasteners 76 do not tighten down onto the surface of the bulkhead 68, there is no need to loosen these fasteners in order to twist the bulkhead. The payload section 2 and bulkhead 68 are then moved axially in the direction of arrow "B" to disconnect them from the central body section 4. One connector may be provided that carries all wires (e.g., power, digital, analog, network) that provide communications between the payload section 2 and the central body section 4.

In this manner the payload section 2 can be quickly disassembled from the central body section 4 simply by loosening a single fastener, and twisting the two apart. The user can then quickly install another payload section with the central body section 4 and send the vehicle back out on another run. Alternatively, the user can reattach the payload section 2 to another central body section 4 having a fully charged battery 10. In another case, the user can simply remove a depleted battery 10 from the central body section, install a fully charged battery, reinstall the payload section 2 and send the recharged vehicle back out on another run.

Although the system has been described in relation to A-sized vehicles it will be appreciated that the arrangements disclosed herein could find application in any of a variety of vehicles of different sizes and configurations.

Further, although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A system for controlling an underwater vehicle, comprising:

a linear control assembly comprising a motor and a threaded rod, the motor engaged with an internally threaded member that is threadably engaged with and surrounding the threaded rod;

a control rod connected to the threaded rod;

a fin assembly connected to the control rod;

a sensor for sensing a position of the threaded rod; and a control system configured to compute an angular position of the fin assembly based on a sensed position of the threaded rod, wherein actuation of the motor rotates the internally threaded member, thereby causing a linear movement of the threaded rod, the control rod, and the fin assembly.

2. The system of claim 1, wherein the fin assembly is rotatably connected to the control rod such that a linear movement of the control rod rotates the fin assembly.

3. The system of claim 1, wherein the sensor comprises a rheostat.

4. The system of claim 1, the control system including a processor in communication with the sensor, to control the underwater vehicle to perform a desired action.

5. The system of claim 1, further comprising a global positioning system (GPS) in communication with the control system, wherein the control system is configured to instruct the motor to adjust a position of the fin assembly based on a signal received from the GPS.

6. The system of claim 1, further comprising a compass in communication with the control system, wherein the control system is configured to instruct the motor to adjust a position of the fin assembly based on a signal received from the compass.

7. The system of claim 1, further comprising an inertial measuring unit (IMU) in communication with the control system, wherein the control system is configured to instruct the motor to adjust a position of the fin assembly based on a signal received from the IMU.

8. A system for controlling an underwater vehicle, comprising:

a linear control assembly comprising a motor and a threaded rod, the motor engaged with an internally threaded member that is threadably engaged with and surrounding the threaded rod;

a control rod connected to the threaded rod;

a fin assembly connected to the control rod; and a spring calibrated to compensate for forces of seawater pressure on said linear control assembly and linkage rods, said spring engaged with and providing a pre-load on the threaded rod that acts in a direction opposite to the load applied by the sea, wherein actuation of the motor rotates the internally threaded member, thereby causing a linear movement of the threaded rod, the control rod, and the fin assembly.

9. The system of claim 1, wherein the fin assembly includes an elevator or a rudder.

10. A modular payload system for an underwater vehicle having a payload section and a central body section, the system comprising:

a payload section having a bulkhead section, and a central body section, the central body section having a circumferential lip portion and a plurality of fasteners circumferentially disposed on the lip portion, wherein at least one of the plurality of fasteners comprises an increased diameter head that is larger than an opening dimension of the respective transversely disposed locking section; and wherein the central body section is engageable with the bulkhead section by aligning the plurality of fasteners with the axially-disposed openings of the recesses, pressing the bulkhead section toward the central body portion, and twisting the bulkhead portion with respect to the central body portion to engage the plurality of fasteners with the transversely disposed locking sections of the plurality of recesses.

11. The system of claim 10, wherein the payload section comprises a payload selected from the list consisting of sound simulation equipment, a sensor, a camera, a Doppler velocity log, an uplooking sonar, and a conductivity-temperature-density measuring device.

12. The system of claim 11, further comprising a payload processor in communication with the payload and with a main processor of the underwater vehicle, the payload processor configured to transmit data to the main processor based on signals received from the payload.

13. The system of claim 11, further comprising a wireless or satellite modem in communication with the main processor for offloading data obtained from the payload.

14. The system of claim 11, wherein the communications between the payload processor and the main processor are wireless.

15. The system of claim 10, further comprising a removable battery disposed in the central body section.

16. The system of claim 15, wherein the removable battery is rechargeable.

17. The system of claim 12, wherein the payload processor comprises a wireless transmitter configured to transmit signals to, and receive signals from, at least one other underwater vehicle.

18. The system of claim 8, wherein said spring is a coil spring.

19. The system of claim 8, further comprising a sensor for sensing a position of the threaded rod.

20. The system of claim 19, further comprising a control system including a processor in communication with the sensor, the control system configured to compute an angular position of the fin assembly based on a sensed position of the threaded rod.

* * * * *